US005948183A

United States Patent [19]

Okada et al.

[11] Patent Number: 5,948,183

[45] Date of Patent: Sep. 7, 1999

[54] HOT-ROLLED STEEL SHEET AND METHOD FOR FORMING HOT-ROLLED STEEL SHEET HAVING LOW YIELD RATIO, HIGH STRENGTH AND EXCELLENT TOUGHNESS

[75] Inventors: Susumu Okada, Chiba; Masahiko Morita; Fumimaru Kawabata, both of Okayama, all of Japan

[73] Assignee: Kawasaki Steel Corporation, Hyogo, Japan

[21] Appl. No.: 08/947,388

[22] Filed: Oct. 8, 1997

Related U.S. Application Data

[63] Continuation of application No. 08/620,030, Mar. 21, 1996, abandoned.

[30] Foreign Application Priority Data

Mar. 23, 1995 [JP] Japan ..... 7-064094

[51] Int. Cl.[6] ..... C21D 8/02

[52] U.S. Cl. ..... 148/330; 148/654; 148/602

[58] Field of Search ..... 148/602, 654, 148/661, 330

[56] References Cited

FOREIGN PATENT DOCUMENTS

| | | | |
|---|---|---|---|
| 58-42725 | 3/1983 | Japan | 148/602 |
| 60-197847 | 10/1985 | Japan | 148/602 |
| A-62-23056 | 1/1987 | Japan . | |
| A-62-35452 | 2/1987 | Japan . | |
| A-62-112722 | 5/1987 | Japan . | |
| 2282419 | 11/1990 | Japan | 148/602 |
| 5-222484 | 8/1993 | Japan . | |
| 6-220576 | 8/1994 | Japan . | |

*Primary Examiner*—Deborah Yee
*Attorney, Agent, or Firm*—Oliff & Berridge, PLC

[57] ABSTRACT

The present invention provides a hot-rolled steel sheet having a low yield ratio, a high specific strength, and excellent toughness. The hot-rolled steel sheet comprises: 0.005 to less than 0.030 weight percent of carbon, 1.5 weight percent or less of silicon, 1.5 weight percent or less of manganese, 0.020 weight percent or less of phosphorus, 0.015 weight percent or less of sulfur, 0.005 to 0.10 weight percent of aluminum, 0.0100 weight percent or less of nitrogen, 0.0002 to 0.0100 weight percent of boron, at least one element selected from the group consisting of 0.20 weight percent or less of titanium and 0.25 weight percent or less of niobium in an amount to satisfy $(Ti+Nb/2)/C \geqq 4$, and balance iron and incidental impurities. The metal structure is selected from the group consisting of ferrite and bainitic ferrite. The amount of carbon dissolved in grains ranges from 1.0 to 4.0 ppm. The present invention also provides a method for producing a hot-rolled steel sheet. The method includes hot-rolling a steel slab containing the above components, cooling at a rate of between 5 to not more than 20° C./sec., and then coiling at a temperature ranging from over 550° C. to 700° C.

4 Claims, 3 Drawing Sheets

HOT-ROLLED STEEL SHEET AND METHOD FOR FORMING HOT-ROLLED STEEL SHEET HAVING LOW YIELD RATIO, HIGH STRENGTH AND EXCELLENT TOUGHNESS

This is a Continuation of application Ser. No. 08/620,030 filed Mar. 21, 1996 now abandoned.

BACKGROUND OF THE INVENTION

1. Field of the Invention

The present invention relates to a hot-rolled steel sheet that is suitable for steel pipes, tubes and columns for architecture and civil engineering, electric resistance welded tubes for oil wells, and other general structural materials.

2. Description of the Related Art

Hot-rolled steel sheets that are used as architectural tubes and columns must be strong and tough. Hot-rolled steel sheets that are formed into electric resistance welded tubes must be resistant to "sour fluids", i.e. wet hydrogen sulfide environments.

A conventional method of producing hot-rolled steel sheets having the requisite strength and toughness includes a strengthening step by fining the micro structure achieved by heat treatment with working, e.g. "a thermo-mechanical control process (TMCP)," as disclosed in Japanese Laid-Open Patent No. 62-112,722, Japanese Examined Patents Nos. 62-23,056 and 62-35,452. The conventional method also includes a quenching or controlled cooling step subsequent to the hot-rolling step.

However, conventional methods of producing strong and tough hot-rolled steel sheets are subject to the following problems:

1) The excessive fining of grains, such as TMCP, inevitably increases the yield ratio, i.e., yield strength/tensile strength. Conventional methods, therefore, do not provide the low yield ratio required to prevent buckling and unstable ductile fracture.

2) The sheet cannot be deformed in the thickness direction during the rolling step in the TMCP. Some inhomogeneity in the thickness direction, therefore, occurs in the material. The controlled cooling causes inhomogeneity in the rolling direction of the materials, which makes it hard to control the material quality. Accordingly, the conventional method creates some inhomogeneity in both the thickness and the rolling directions.

3) The conventional TMCP requires a higher rolling reduction at a lower temperature to prevent the formation of austenite crystal grains, and to provide a strong and tough material. This requirement increases the load of the hot-rolling line, and limits the upper size of the hot-rolling material.

4) Strengthening elements used in the conventional TMCP, such as manganese, vanadium, molybdenum, significantly affect material properties, i.e. increased hardenability, increased hardness at the weld section, and decreased toughness at the weld section due to martensite islands generated therein. Therefore, it is difficult to achieve high strength by the TMCP while maintaining satisfactory weld properties.

SUMMARY OF THE INVENTION

It is, therefore, an object of the present invention to provide a high strength, hot-rolled steel sheet, which has excellent toughness, as well as a low yield ratio. These advantages are provided without creating material inhomogeneity in the thickness and length directions, deterioration of welding properties, and deterioration of sour resistance. It is also an object of the invention to provide a profitable process for making a hot-rolled steel sheet having the above-described properties.

The hot-rolled steel sheet in accordance with the present invention has the following properties. The yield strength (YR) is 276 MPa or more, and preferably 413 MPa or more. The yield ratio (YR) is 80% or less, and preferably 70% or less. The toughness at the fracture transition temperature (vTrs) is −100° C. (corresponding to −30° C. of DWTT 85% test) or less, and preferably −120° C. (corresponding to −46° C. of DWTT 85% test) or less. The Charpy absorbed energy (vEo) is 300 J or more, and preferably 310 J or more. The index indicating the balance between strength and toughness, 0.3 TS-vTrs, is 300 or more, and preferably 320 or more. The difference of the Vickers hardness between the weld section and the base metal (ΔHv) is 100 or less, preferably 30 or less. The toughness of the weld heat affected zone (HAZ) in terms of vTrs is 0° C. and preferably −20° C. The steel sheet of the invention shows high sour resistance.

The following conclusion has been reached after careful analysis. When boron is added as a carbide precipitating element to a tow carbon steel via an expediently controlled process condition: 1) the toughness of the ferrite matrix is improved, and the YR is decreased because a desirable amount of carbon is dissolved in grains; 2) the carbide precipitant affects the improved strength; 3) the loss of strength due to the coarsening of grains that is observed in conventional steels having a low dissolved carbon content is prevented; and 4) the toughness and sour resistance is improved by a ferrite (including bainitic ferrite) single phase texture.

In accordance with the present invention, a hot-rolled steel sheet having a low yield ratio, a high strength, and excellent toughness, comprises: 0.005 to less than 0.030 weight percent of carbon (C), 1.5 weight percent or less of silicon (Si), 1.5 weight percent or less of manganese (Mn), 0.020 weight percent or less of phosphorus (P), 0.015 weight percent or less of sulfur (S), 0.005 to 0.10 weight percent of aluminum (Al), 0.0100 weight percent or less of nitrogen (N), 0.0002 to 0.0100 weight percent of boron (B), at least one element selected from 0.20 weight percent or less of titanium (Ti) and 0.25 weight percent or less of niobium (Nb) in an amount to satisfy $(Ti+Nb/2)/C \geqq 4$, and balance iron and incidental impurities. The metal structure comprises ferrite and/or bainitic ferrite, and the carbon content is dissolved in grains ranging from 1.0 to 4.0 ppm.

The hot-rolled steel sheet having a low yield ratio, a high strength, and excellent toughness further comprises at least one element selected from the group consisting of: 1.0 weight percent or less of molybdenum, 2.0 weight percent or less of copper, 1.5 weight percent or less of nickel, 1.0 weight percent or less of chromium, and 0.10 weight percent or less of vanadium.

The hot-rolled steel sheet having a low yield ratio, a high strength and excellent roughness further comprises at least one element selected from the group consisting of: 0.0005 to 0.0050 weight percent of calcium, and 0.001 to 0.020 weight percent of a rare earth metal.

A method of making a hot-rolled steel sheet having a low yield ratio, a high strength and excellent toughness, comprises: hot-rolling a steel slab containing: 0.005 to less than 0.030 weight percent of carbon (C), 1.5 weight percent or less of silicon (Si), 1.5 weight percent or less of manganese (Mn), 0.020 weight percent or less of phosphorus (P), 0.015 weight percent or less of sulfur (S), 0.005 to 0.10 weight percent of aluminum (Al), 0.0100 weight percent or less of nitrogen (N), 0.0002 to 0.0100 weight percent of boron (B), and at least one element selected from 0.20 weight percent or less of titanium (Ti) and 0.25 weight percent or less of niobium (Nb) in an amount to satisfy (Ti+Nb/2)/C≧4; cooling at a rate of from 5 to not more than 20° C./sec.; and then coiling at a temperature ranging from over 550° C. to 700° C.

DETAILED DESCRIPTION OF THE PREFERRED EMBODIMENTS

Hot-rolled steel sheets of the present invention, each having a thickness of 12 to 20 mm, were produced by hot-rolling steel slabs containing 0.003 to 0.030 weight percent of carbon, 0.4 weight percent of silicon, 0.6 weight percent of manganese, 0.010 weight percent of phosphorus, 0.0020 weight percent of sulfur, 0.035 weight percent of aluminum, 0.0018 to 0.0043 weight percent of nitrogen, 0.0008 to 0.0015 weight percent of boron, 0 to 0.12 weight percent of titanium, and 0 to 0.25 weight percent of niobium. The hot-rolled steel sheets satisfy the formula: (Ti+Nb/2)/C≧2–10, at a slab reheating temperature (SRT) of 1,200° C., a finishing delivery temperature (FDT) of 880° C., a cooling rate after hot-rolling of 3 to 30° C./sec., and at a coiling temperature (CT) of 500 to 750° C. When the coiling temperature CT exceeds 750° C., the cooling rate is the amount of time it takes until the temperature reaches 700° C.

The hot-rolled steel sheets were tested to determine the amount of carbon dissolved in grains, the physical properties, such as yield strength (YS), tensile strength (TS), and yield ratio (YR=YS/TS), brittle fracture transition temperature (vTrs), and the calculation of 0.3 TS (MPa)–vTrs (° C.) based on such data. The YS was based upon the value at 0.5% strain according to the API standard. This value corresponds to 0.2% proof stress for a non-aging steel, or a lower yield stress for an aging steel.

The amount of carbon dissolved in grains was evaluated by using the aging index (AI). The aging index indicates the hardening extent of the sample having 7.5% pre-strain after the heat treatment at 100° C. for 30 minutes. The aging index is not affected by the amount of carbon dissolved in the interface. However, the aging index is related to the amount of carbon dissolved in grains as follows: C (ppm)=0.20×AI (Mpa). The amount of carbon dissolved by the internal friction method for low carbon hot-rolled steel sheets cannot be determined because this method is affected by the amount of carbon dissolved in the grain boundary, the grain size, and the grain shape.

General strengthening, such as precipitation and dissolution strengthening, deteriorates the toughness and increases the vTrs. The toughness deterioration must, therefore, be taken into account prior to comparing the toughness of steel sheets having different strengths. The change of toughness due to strengthening is equivalent experimentally to 0.3 TS (MPa). Therefore, the lower vTrs—0.3 TS or the higher 0.3 TS—vTrs, the better the toughness after correcting the strengthening effect. The toughness obtained by such a method represents the toughness due to the original toughness of the crystalline matrix, and the toughness based on fine grains.

Figure 1:
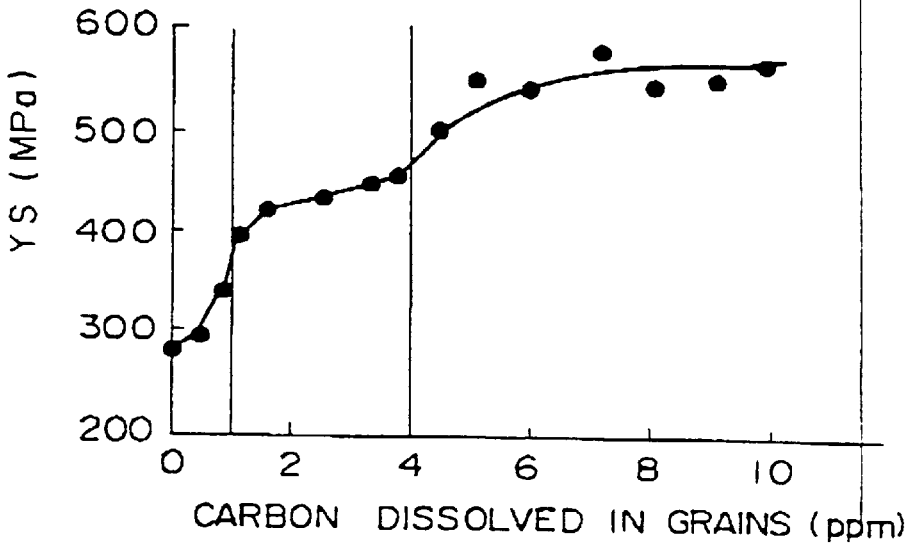
FIG. 1 is a graph illustrating the correlation between the amount of carbon dissolved in grains and the yield strength (YS)
Figure 2:
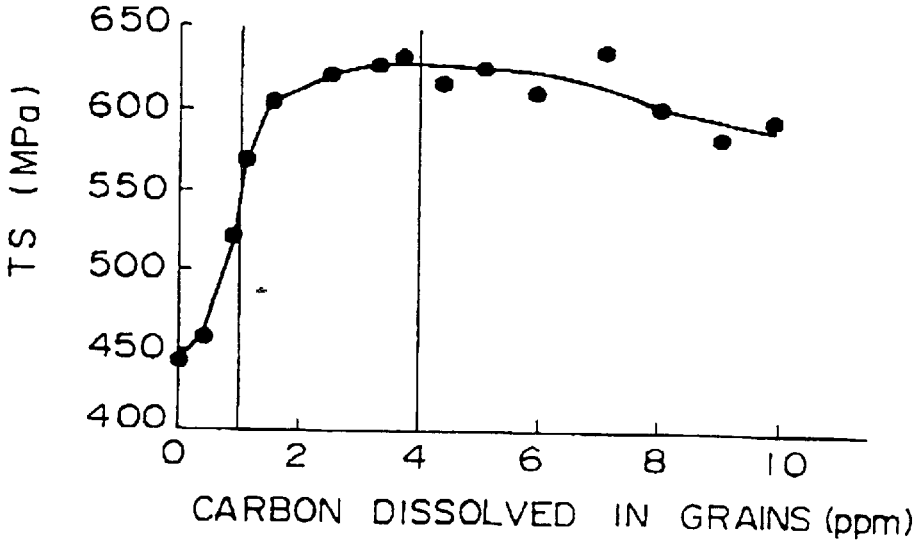
FIG. 2 is a graph illustrating the correlation between the amount of carbon dissolved in grains and the tensile strength (TS).
Figure 3:
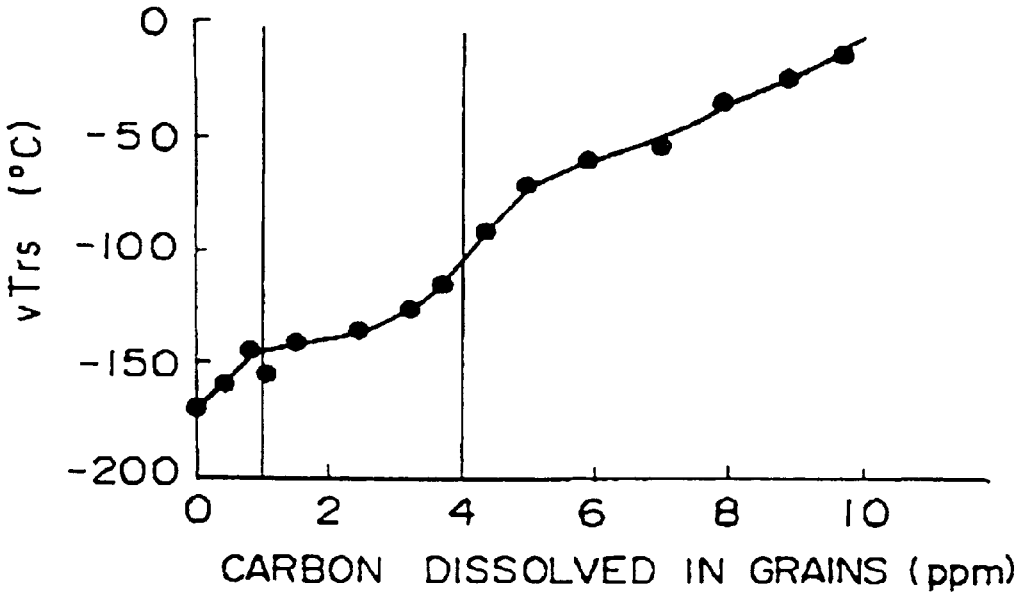
FIG. 3 is a graph illustrating the correlation between the amount of carbon dissolved in grains and the fracture transition temperature (vTrs).
Figure 4:
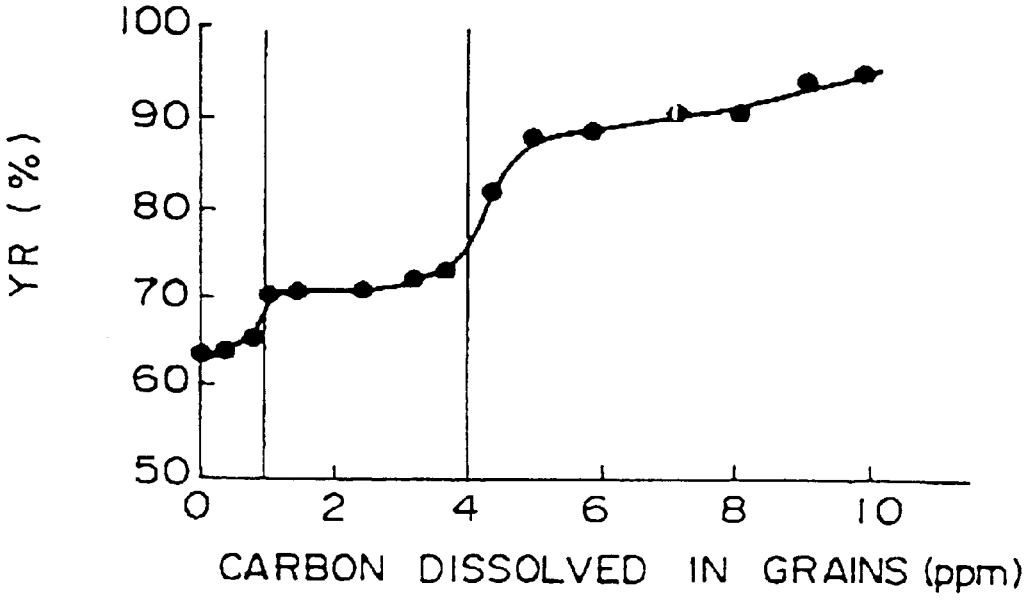
FIG. 4 is a graph illustrating the correlation between the amount of carbon dissolved in grains and the yield ratio (YR).
Figure 5:
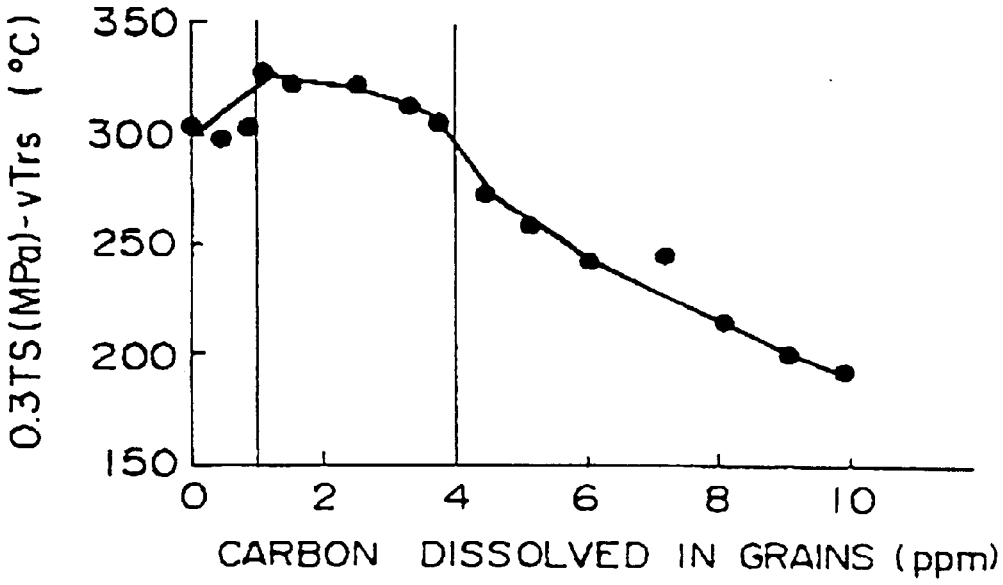
FIG. 5 is a graph illustrating the correlation between the amount of carbon dissolved in grains and 0.3 TS-vTrs.

FIGS. 1 through 5 show correlations between the amount of carbon dissolved in grains and steel sheets having the above-described properties.

FIGS. 1 through 5 demonstrate that an excellent toughness and a low yield ratio are obtainable when the amount of carbon dissolved in grains is controlled to between 1.0 and 4.0 ppm.

The low yield ratio is achieved by decreasing the amount of carbon dissolved to 4.0 ppm or less, because the upper yield point is not affected, the decreased dislocation fixed in the dissolved carbon, and the relatively increased movable dislocation.

Toughness is improved because of a decrease in the energy absorbed. The energy absorbed is decreased because of readily plastic deformation to the low temperature impact deformation. This operation is similar to that of the low yield ratio.

However, the strength is decreased when the amount of carbon dissolved in grains is decreased to less than 1.0 ppm. The 0.3 TS—vTrs value is slightly decreased because of the coarsened crystal grains, even though the yield ratio is decreased.

Hot-rolled steel sheets of excellent toughness and low yield ratio are thereby produced by controlling the amount of carbon dissolved in grains to a range of between 1.0 and 4.0 ppm.

The invention also includes the chemical composition and structure of a steel sheet having the above-described properties. The following is a detailed discussion of the chemical compositions of the steel sheet.

1) Carbon: 0.005 weight percent to less than 0.030 weight percent

Carbon improves the strength of the steel sheet by precipitation strengthening in the presence of titanium and niobium. A low carbon content causes a coarsening of the grains. High strength cannot be achieved with a carbon content of less than 0.005 weight percent, unless an excessive amount of strengthening element is added. Further, grains have a tendency to grow in the welding section. This growth results in rupture due to softening.

Conversely, it is difficult to decrease the amount of carbon dissolved in grains to a predetermined amount when carbon is added in an amount greater than 0.030 weight percent, even if a quantity of niobium and titanium are added. Further, the toughness at the welding section decreases, because martensite islands form in the welding section. Accordingly, the preferred amount of carbon ranges from 0.005 to less than 0.030 weight percent.

Specifically, the most preferred amount of carbon ranges from 0.015 to 0.028 weight percent.

2) Silicon: 1.5 weight percent or less

Silicon is a useful strengthening element and only minimally affects the toughness of steel having a low dissolved carbon content. However, an amount of silicon exceeding 1.5 weight percent decreases both the toughness and the fracture sensitivity at the weld section. Thus, the silicon content is set at 1.5 weight percent or less. Preferably, 0.8 weight percent or less should be used.

3) Manganese: 1.5 weight percent or less

Manganese is useful as a strengthening element. However, adding more than 1.5 weight percent increases the hardness at the welding section, and decreases its fracture sensitivity. Further, the formation of martensite islands decreases the toughness. Moreover, adding too much manganese decreases the diffusion speed of the dissolved carbon, and prevents the decrease in the amount of carbon dissolved in grains caused by the carbide precipitation. Thus, the preferred manganese content is 1.5 weight percent or less. Specifically, the most preferred amount of manganese is 0.8 weight percent or less.

4) Phosphorus: 0.020 weight percent or less

Phosphorus does not affect the toughness of steel having a carbon content in accordance with the present invention. However, more than 0.020 weight percent of phosphorus significantly deteriorates the toughness of the steel. Thus, the phosphorus is set at 0.020 weight percent or less. Preferably, 0.012 weight percent or less should be used.

5) Sulfur: 0.015 weight percent or less

Sulfur decreases the sour resistance of the steel sheet because of sulfide formation. The amount of sulfur is diminished as much as possible. Thus, the maximum amount of sulfur is 0.015 weight percent or less. Preferably, 0.005 weight percent or less should be used.

6) Aluminum: 0.005 to 0.10 weight percent

Aluminum is used for the deoxidation of the steel, and the fixation of nitrogen. In order to achieve such effects, at least 0.005 weight percent of aluminum must be added into the steel. However, more than 0.10 weight percent of aluminum raises the material cost too much. Thus, between 0.005 and 0.10 weight percent of aluminum should be used.

7) Nitrogen 0.0100 weight percent or less

Nitrogen decreases the toughness and increases the YR when dissolved. Nitrogen is, therefore, fixed in the form of nitrides of titanium, aluminum and boron. Too much nitrogen increases the material costs since titanium, aluminum and boron are expensive. It is, therefore, desirable to reduce the nitrogen content. The maximum amount of nitrogen is 0.0100 weight percent or less. Preferably, 0.0050 weight percent or less should be used.

8) Boron: 0.0002 to 0.0100 weight percent

Boron is essential to secure both toughness and strength, since it prevents the excessive growth of crystal grains. Boron, is also essential to prevent the precipitation of coarse carbides at higher temperatures due to the decreased transformation temperature. Boron cannot provide these advantages at less then 0.0002 weight percent. Conversely, adding more than 0.0100 weight percent of boron causes decreased toughness due to an excessive quenching effect. Thus, between 0.0002 and 0.0100 weight percent of boron should be used. Specifically, between 0.0005 and 0.0050 weight percent of boron should be used.

9) Titanium: 0.20 weight percent or less, Niobium: 0.25 weight percent or less, and $(Ti+Nb/2)/C \geqq 4$ Titanium and niobium are important elements of the present invention. Titanium and niobium control the amount of carbon dissolved in grains by precipitating the dissolved carbon, and form titanium carbide and niobium carbide. This formation increases strength due to precipitation strengthening. The formula $(Ti+Nb/2)/C \geqq 4$ must be satisfied to achieve these advantages. However, excessive amounts of titanium and niobium increase inclusions, and thus decrease the toughness at the weld section. Therefore, no more than 0.20 weight percent or less of titanium is used, and no more than 0.25 weight percent or less of niobium is used. Additionally, the preferred range of the formula $(Ti+Nb/2)/C$ is between 5 and 8.

In addition to the basic components explained above, molybdenum, copper, nickel, chromium, vanadium, calcium, and/or at least one rare earth metal may be added. The preferred amounts of each element is as follows: 1.0 weight percent or less of molybdenum, 2.0 weight percent or less of copper, 1.5 weight percent or less of nickel, 1.0 weight percent or less of chromium, and 0.10 weight percent or less of vanadium.

These elements can be used as strengthening elements. However, too much of each of these elements decreases toughness at the weld section. Thus, the preferred amount of each of these elements is limited to the above-described ranges.

10) Calcium: 0.0005 to 0.0050 weight percent and Rare Earth Metal: 0.001 to 0.020 weight percent Calcium and any rare earth metal operate to sphere the shape of the sulfides and thus improve the toughness, the sour resistance, and the welding properties. However, too much of these elements decrease toughness because of increased inclusions. Therefore, the amount of each of these elements is limited to the above-described ranges.

11) Metal Structure and Carbon Content Dissolved into Grains

The metal structure of the present invention must be ferrite and/or bainitic ferrite. Adding the proper amount of these structures can decrease macroscopic defects, decrease toughness, and prevent sour resistance, even after high precipitation strengthening. In contrast, conventional steels use a complex micro structure comprising ferrite and pearlite that includes many macroscopic defects for strengthening.

The amount of carbon dissolved in grains must be limited to between 1.0 and 4.0 ppm (by weight) to achieve excellent toughness and low yield ratio, as shown in FIGS. 1 through 5.

The Ferrite and/or bainitic ferrite can be obtained by producing a steel having a component in accordance with the below-described process.

The invention also includes a process for making the hot-rolled steel sheet. The following is a detailed discussion of the steps of the process for making the steel sheet.

12) Cooling Rate after Hot-Rolling

The cooling rate, from hot-rolling to coiling, must be controlled in order to adjust the amount of carbon dissolved in grains by precipitating carbides. Specifically, the cooling rate at over 700° C. is critical. A cooling rate of less than 5° C./sec. coarsens crystal grains and decreases toughness. Conversely, a cooling rate over 20° C./sec. can cause insufficient carbide precipitation and decrease toughness due to the residual strain in ferrite grains. An excessive cooling speed often causes an unstable cooling speed over the entire hot-rolled steel coil. This causes material inhomogeneity to form in the longitudinal direction of the steel coil, and between the surface and inner portion of the steel coil. The material inhomogenity results in the steel sheet shape becoming inferior. Accordingly, the cooling rate after hot-rolling must be controlled to between 5° C./sec. and not more than 20° C./sec. Preferably the cooling rate after hot-rolling is between 5° C./sec. and less than 10° C./sec. and more preferably from 5° C./sec. to 10° C./sec.

13) Coiling Temperature (CT)

The adjustment of the amount of carbon dissolved in grains due to carbide precipitation and the precipitation strengthening are mainly accomplished at a slow cooling step after coiling. The coiling temperature after hot-rolling is, therefore, very important. The dissolved carbon content does not sufficiently decrease when the coiling temperature is 550° C. or less. This coiling temperature makes it difficult to obtain a uniform material. Conversely, excessive aging often occurs when the coiling temperature exceeds 700° C. This increased coiling temperature results in decreased precipitation strengthening. In other words, high strength cannot be achieved when the dissolved carbon content is too low. Accordingly, the coiling temperature after hot-rolling is between 550° C. and 700° C. Preferably, the coiling temperature is more than 600° C.

A high toughness, low yield ratio steel strengthened by the precipitation of the interstitial free (IF) steel is proposed in Japanese Laid-Open Patent No. 5-222,484, although in the field of the fire proofing steel. However, the conception of the proposed technology, in which it is desirable that the dissolved carbon is substantially contained, differs from that of the present invention in which the lower limit of the dissolved carbon is essential. Further, in the disclosed process and examples of the technology, quenching and coiling at a low temperature of 550° C. or less must be carried out after the hot rolling to secure the fire proofing property. However, according to the investigation of the present inventors, the dissolved carbon actually exists in the amount exceeding 4.0 ppm in the steel sheet obtained by such conditions, the same level of the compatibility of the strength between toughness as the present invention will not be expected in such a technology.

The cooling rate and coiling temperature after hot-rolling set forth above are particularly important constituents of the present invention, and enable the steel sheet to be homogeneously treated over its entire length and width.

The slab may be hot-rolled immediately after continuous casting, e.g. CC-DR. The slab can also be hot-rolled after re-heating to a slab reheating temperature (SRT) of between 900 and 1,300° C. The SRT is preferably less than 1,200° C. in order to save energy. Auxiliary heating may be applied to the slab end when the CC-DR is used.

The slab can be hot-rolled under ordinary conditions, e.g., at a finishing delivery temperature (FDT) of between 750 and 950° C. However, a FDT lower than the $Ar_3$ transformation temperature, e.g. 100° C., causes the precipitation of carbides during hot-rolling. This precipitation results in an undesirable decrease of precipitation strengthening.

In the steel sheet of with the present invention, high toughness and strength can be achieved by controlling the amount of carbon dissolved in the matrix, and by fining grains by adding boron. Therefore, controlled rolling, e.g. a high rolling reduction at an austenite grain non-recrystallizing temperature range, is not always required. The temperature of producing the steel sheet by controlled rolling is desirably maintained at below 900° C. with a rolling deduction rate of 50% or more, preferably 60% or more, because the recrystallization temperature is decreased to approximately 900° C. by the decreased carbon content.

The finishing thickness after hot-rolling may range from 5 to 30 mm, depending on the use.

Hot-rolled steel sheet is produced by the above-described process. However, the process is also applicable to producing thick plates. For example, the steps leading up to cooling after hot-rolling may be carried out substantially as described above. A plate having qualities similar to the hot-rolled steel sheet described above is produced by maintaining or slow-cooling the plate at a temperature range of between 600 and 700° C. for at least 1 hour or more.

Tables 1-1–3-2 are described below. The tables show reheating steel slabs of various compositions. Table 2 shows the hot-rolling of steel slabs to form steel sheets, each sheet having a thickness of 15 mm.

Each micro structure of the hot-rolled steel sheets that was obtained by the above-described process was studied. The amount of carbon dissolved in grains was determined. The mechanical properties of the steel sheets were observed. The observed mechanical properties include yield strength, tensile strength, yield ratio, brittle fracture transition temperature, absorbed energy at 0° C., 0.3 TS-vTrs, and hydrogen induced cracking (HIC) as a measure of the sour resistance. Additionally, subsequent to electric resistance welding each sheet by tubing mill, the weld section was evaluated based on Vickers maximum hardness (Hv), the difference of hardness between the weld section and base metal (ΔHv), and the brittle fracture transition temperature of coarse grains at the heat affected zone.

The amount of carbon dissolved in grains was calculated from the above-described AI by the following equation: The carbon content (ppm)=0.20×AI (MPa). The tensile strength of the steel sheet is determined by using a JIS #5 test piece according to JIS Z2201. The impact test was carried out by using a Charpy test piece according to JIS Z2202.

The HIC was determined according to NACE TM-02-84. The test solution used was the NACE solution specified in NACE TM0177-90. The HIC was evaluated as follows: ○ good when no crack is found by an ultrasonic survey; Δ fairy for crack size of less than 1 percent represented by crack sensitivity ratio (CSR); and× no good for crack size of 1 percent or more.

Table 2 summarizes the metal structure and the amount of carbon dissolved in grains. Table 3 summarizes the mechanical properties and the sour resistance.

Tables 1-1–3-2 demonstrate that each of the hot-rolled steel sheets of the present invention have the following properties. Regarding the base metal properties, the yield strength (YS) is 276 MPa or more, the yield ratio (YR) is 80% or less, the brittle fracture transition temperature (vTrs) is −110° C. or less, the Charpy absorbed energy at 0° C. (vEo) is 300 J or more, the 0.3 TS-vTrs is 300 or more, and the sour resistance is good. On the weld section, the hardness difference between the weld section and the base metal (ΔHv) is 100 or less, the brittle transition temperature (vTrs) at the heat affected zone (HAZ) is 0° C. or less. Thus, the steel sheet in accordance with the present invention has a low yield ratio, a high strength, excellent impact properties, high sour resistance, and excellent welding properties.

In particular, samples 1A, 2A, 3 through 6, and 8 through 16 have excellent properties. The YS of each base sheet is 413 MPa or more, the YR is 70% or less, the vTrs is −120° C. or less, the vEo is 0.3 TS-vTrs is 320 or more, the ΔHv is 30 or less, and the vTrs at HAZ is −20° C. or less.

At least one of the following characteristics including: toughness, yield ratio, properties at the weld section, and sour resistance, is adversely affected when the steel sheets include properties outside of the above-described limits.

In accordance with the present invention as set forth above, a hot-rolled steel sheet has excellent toughness, welding properties, and sour resistance. The hot-rolled steel sheet also has a low yield ratio, without material inhomogeneity in the thickness and longitudinal direction. Thus, the hot-rolled steel sheets are strong and tough enough for use as architectural tubes and columns. The hot-rolled steel sheets are also resistant to sour fluids and can, therefore, be formed into electric resistance welded tubes for oil wells.

TABLE 1-1

| | Chemical Components (wt %) | | | | | | | | | | | Chemical Components (wt %) | | | |
|---|---|---|---|---|---|---|---|---|---|---|---|---|---|---|---|
| | | | | | | | | | | | | Group 1 | Group 2 | (Ti + | |
| No. | C | Si | Mn | P | S | Al | Ti | Nb | N | B | Remarks | Elements | Elements | Nb/2)/C | Remarks |
| 1 | 0.020 | 0.50 | 0.50 | 0.008 | 0.0011 | 0.034 | 0.010 | 0.19 | 0.0031 | 0.0009 | Example | | | 5.3 | Example |
| 2 | 0.021 | 0.41 | 0.62 | 0.008 | 0.0010 | 0.032 | 0.083 | 0.05 | 0.0028 | 0.0010 | Example | | | 5.1 | Example |
| 3 | 0.019 | 0.58 | 0.61 | 0.007 | 0.0012 | 0.051 | — | 0.20 | 0.0020 | 0.0008 | Example | | | 5.3 | Example |
| 4 | 0.019 | 0.38 | 0.40 | 0.008 | 0.0021 | 0.020 | 0.110 | — | 0.0023 | 0.0010 | Example | | | 5.8 | Example |
| 5 | 0.024 | 0.35 | 0.42 | 0.007 | 0.0015 | 0.044 | 0.072 | 0.10 | 0.0024 | 0.0010 | Example | | | 5.1 | Example |
| 6 | 0.028 | 0.14 | 0.33 | 0.005 | 0.0020 | 0.047 | 0.061 | 0.17 | 0.0026 | 0.0005 | Example | | | 5.2 | Example |
| 7 | 0.010 | 0.80 | 1.00 | 0.006 | 0.0018 | 0.034 | 0.023 | 0.05 | 0.0026 | 0.0030 | Example | | | 4.8 | Example |

TABLE 1-2

| | Chemical Components (wt %) | | | | | | | | | | | Chemical Components (wt %) | | (Ti + | |
|---|---|---|---|---|---|---|---|---|---|---|---|---|---|---|---|
| | | | | | | | | | | | | Group 1 | Group 2 | Nb/ | |
| No. | C | Si | Mn | P | S | Al | Ti | Nb | N | B | Remarks | Elements | Elements | 2)/C | Remarks |
| 8 | 0.016 | 0.70 | 0.78 | 0.004 | 0.0021 | 0.050 | 0.010 | 0.22 | 0.0042 | 0.0013 | Example | | | 7.5 | Example |
| 9 | 0.022 | 0.20 | 0.65 | 0.005 | 0.0015 | 0.054 | 0.097 | 0.03 | 0.0027 | 0.0011 | Example | Mo:0.35 | | 5.1 | Example |
| 10 | 0.016 | 0.61 | 0.36 | 0.010 | 0.0018 | 0.049 | 0.015 | 0.15 | 0.0027 | 0.0041 | Example | cr:0.80 | | 5.6 | Example |
| 11 | 0.018 | 0.35 | 0.25 | 0.012 | 0.0013 | 0.033 | 0.030 | 0.13 | 0.0027 | 0.0012 | Example | V:0.03 | | 5.3 | Example |
| 12 | 0.024 | 0.40 | 0.48 | 0.009 | 0.0012 | 0.032 | 0.077 | 0.10 | 0.0025 | 0.0009 | Example | Cu:1.20 Ni:0.80 | | 5.3 | Example |
| 13 | 0.018 | 0.30 | 0.50 | 0.009 | 0.0014 | 0.054 | 0.090 | 0.01 | 0.0027 | 0.0005 | Example | Mo:0.20 Cu:0.20 Ni:0.10 Cr:0.10 V:0.01 | | 5.3 | Example |
| 14 | 0.020 | 0.55 | 0.50 | 0.006 | 0.0020 | 0.055 | 0.150 | 0.01 | 0.0026 | 0.0010 | Example | | REM:0.006 | 7.8 | Example |

TABLE 1-3

| | Chemical Components (wt %) | | | | | | | | | | | Chemical Components (wt %) | | | |
|---|---|---|---|---|---|---|---|---|---|---|---|---|---|---|---|
| | | | | | | | | | | | | Group 1 | Group 2 | (Ti + | |
| No. | C | Si | Mn | P | S | Al | Ti | Nb | N | B | Remarks | Elements | Elements | Nb/2)/C | Remarks |
| 15 | 0.021 | 0.45 | 0.35 | 0.008 | 0.0024 | 0.055 | 0.012 | 0.19 | 0.0027 | 0.0008 | Example | | Ca:0.0021 | 5.1 | Example |
| 16 | 0.018 | 0.47 | 0.46 | 0.007 | 0.0020 | 0.060 | 0.041 | 0.12 | 0.0021 | 0.0027 | Example | Mo:0.80 Cr:0.20 | REM:0.005 Ca:0.0015 | 5.6 | Example |
| 17 | 0.020 | 0.50 | 0.51 | 0.007 | 0.0014 | 0.035 | 0.012 | 0.19 | 0.0031 | — | Comparative Example | | | 5.4 | Comparative Example |
| 18 | 0.020 | 0.50 | 0.51 | 0.008 | 0.0010 | 0.042 | 0.013 | 0.10 | 0.0025 | 0.0008 | Comparative Example | | | 3.2 | Comparative Example |
| 19 | 0.032 | 0.49 | 0.51 | 0.007 | 0.0012 | 0.040 | 0.010 | 0.05 | 0.0024 | 0.0010 | Comparative Example | | | 10.9 | Comparative Example |
| 20 | 0.050 | 0.42 | 0.83 | 0.007 | 0.0013 | 0.037 | 0.150 | 0.24 | 0.0030 | 0.0008 | Comparative Example | | | 5.4 | Comparative Example |
| 21 | 0.025 | 0.23 | 1.82 | 0.009 | 0.0013 | 0.041 | 0.076 | 0.10 | 0.0029 | 0.0010 | Comparative Example | | | 5.0 | Comparative Example |

TABLE 2-1

| No. | Hot-Rolling Conditions SRT (° C.) | FDT (° C.) | Cooling Rate (° C./sec) * | CT (° C.) | Dissolved C (wt/ppm) | Al (MPa) | Structure | Remarks |
|---|---|---|---|---|---|---|---|---|
| 1 A | 1200 | 880 | 8 | 650 | 2.4 | 12 | ferrite + bainitic ferrite | Example |
| 1 B | 1200 | 880 | 8 | 500 | 6.2 | 31 | bainitic ferrite | Comparative Ex. |
| 1 C | 1200 | 880 | 8 | 750 | 0.8 | 4 | ferrite | Comparative Ex. |
| 2 A | 1200 | 860 | 6 | 600 | 2.0 | 10 | ferrite + bainitic ferrite | Example |
| 2 B | 1200 | 860 | 3 | 600 | 1.0 | 5 | ferrite | Example |
| 2 C | 1200 | 860 | 14 | 600 | 3.8 | 19 | ferrite + bainitic ferrite | Example |
| 2 D | 1200 | 860 | 7 | 560 | 3.4 | 17 | bainitic ferrite | Example |
| 2 E | 1200 | 860 | 25 | 600 | 5.2 | 26 | bainitic ferrite | Comparative Ex. |
| 2 F | 1200 | 860 | 18 | 600 | 4.0 | 20 | ferrite + bainitic ferrite | Example |
| 3 | 1200 | 840 | 9 | 700 | 2.6 | 13 | bainitic ferrite | Example |
| 4 | 1200 | 820 | 5 | 650 | 2.2 | 11 | ferrite + bainitic ferrite | Example |
| 5 | 1250 | 840 | 9 | 650 | 2.0 | 10 | ferrite + bainitic ferrite | Example |
| 6 | 1220 | 900 | 9 | 650 | 2.4 | 12 | ferrite + bainitic ferrite | Example |
| 7 | 1180 | 840 | 8 | 600 | 3.4 | 17 | bainitic ferrite | Example |
| 8 | 1180 | 880 | 7 | 650 | 1.2 | 6 | ferrite | Example |

* Cooling rate at 700° C. or more (when CT > 700° C., to coiling).

TABLE 2-2

| No. | Hot-Rolling Conditions SRT (° C.) | FDT (° C.) | Cooling Rate (° C./sec) * | CT (° C.) | Dissolved C (wt/ppm) | Al (MPa) | Structure | Remarks |
|---|---|---|---|---|---|---|---|---|
| 9 | 1180 | 800 | 9 | 650 | 2.8 | 14 | bainitic ferrite | Example |
| 10 | 1100 | 920 | 5 | 650 | 1.6 | 8 | ferrite + bainitic ferrite | Example |
| 11 | 1220 | 920 | 8 | 700 | 2.0 | 10 | ferrite + bainitic ferrite | Example |
| 12 | 1180 | 880 | 9 | 600 | 2.4 | 12 | ferrite + bainitic ferrite | Example |
| 13 | 1050 | 840 | 7 | 650 | 3.0 | 15 | bainitic ferrite | Example |
| 14 | 1280 | 840 | 9 | 650 | 1.2 | 6 | ferrite | Example |
| 15 | 1250 | 900 | 9 | 650 | 2.2 | 11 | ferrite + bainitic ferrite | Example |
| 16 | 1200 | 900 | 6 | 650 | 1.8 | 9 | ferrite + bainitic ferrite | Example |
| 17 | 1200 | 860 | 9 | 560 | 0.8 | 4 | ferrite | Comparative Ex. |
| 18 | 1200 | 860 | 9 | 650 | 10.8 | 54 | bainitic ferrite | Comparative Ex. |
| 19 | 1200 | 820 | 10 | 650 | 1.2 | 6 | ferrite | Comparative Ex. |
| 20 | 1220 | 880 | 9 | 600 | 5.6 | 28 | ferrite + bainitic ferrite | Comparative Ex. |
| 21 | 1200 | 880 | 8 | 600 | 4.8 | 24 | ferrite + bainitic ferrite | Comparative Ex. |

* Cooling rate at 700° C. or more (when CT > 700° C., to coiling).

TABLE 3-1

| No. | Properties of Original Sheet YS (MPa) | TS (MPa) | YR (%) | Hv | vTrs (° C.) | $vE_0$ ° C. (J) | 0.3TS-vTrs | HIC ** | Properties of Weld Section Hv | Δ Hv | vTrs (° C.) |
|---|---|---|---|---|---|---|---|---|---|---|---|
| 1 A | 433 | 639 | 68 | 226 | −140 | 400 | 332 | ○ | 241 | 15 | −45 |
| 1 B | 553 | 642 | 86 | 223 | −50 | 270 | 243 | Δ | 240 | 17 | −30 |
| 1 C | 262 | 430 | 61 | 142 | −170 | 340 | 299 | ○ | 245 | 103 | −35 |
| 2 A | 440 | 641 | 69 | 213 | −140 | 400 | 332 | ○ | 225 | 12 | −40 |
| 2 B | 301 | 435 | 69 | 161 | −170 | 350 | 301 | ○ | 223 | 62 | −40 |
| 2 C | 463 | 646 | 72 | 220 | −110 | 300 | 304 | ○ | 235 | 15 | −35 |
| 2 D | 457 | 645 | 71 | 222 | −120 | 300 | 314 | ○ | 236 | 14 | −35 |
| 2 E | 530 | 655 | 81 | 227 | −60 | 280 | 257 | ○ | 247 | 20 | −20 |
| 2 F | 470 | 648 | 73 | 223 | −110 | 300 | 304 | ○ | 238 | 15 | −35 |
| 3 | 461 | 669 | 69 | 235 | −125 | 380 | 326 | ○ | 252 | 17 | −30 |
| 4 | 418 | 598 | 70 | 201 | −150 | 380 | 329 | ○ | 210 | 9 | −50 |
| 5 | 458 | 657 | 70 | 224 | −130 | 390 | 327 | ○ | 239 | 15 | −30 |
| 6 | 422 | 626 | 67 | 205 | −140 | 380 | 328 | ○ | 224 | 19 | −35 |
| 7 | 456 | 634 | 72 | 213 | −115 | 300 | 305 | ○ | 264 | 51 | −25 |
| 8 | 462 | 692 | 67 | 253 | −120 | 370 | 328 | ○ | 270 | 17 | −25 |

** ○—good, Δ—fair, x—no good

TABLE 3-2

| | Properties of Original Sheet | | | | | | | | Properties of Weld Section | | |
|---|---|---|---|---|---|---|---|---|---|---|---|
| No. | YS (MPa) | TS (MPa) | YR (%) | Hv | vTrs (° C.) | $vE_0$ ° C. (J) | 0.3TS-vTrs | HIC ** | Hv | Δ Hv | vTrs (° C.) |
| 9 | 480 | 687 | 70 | 228 | −120 | 360 | 326 | ○ | 241 | 13 | −30 |
| 10 | 502 | 721 | 70 | 266 | −120 | 360 | 336 | ○ | 288 | 22 | −25 |
| 11 | 474 | 686 | 69 | 201 | −120 | 370 | 326 | ○ | 220 | 19 | −25 |
| 12 | 505 | 717 | 70 | 284 | −120 | 370 | 335 | ○ | 307 | 23 | −30 |
| 13 | 528 | 750 | 70 | 253 | −120 | 380 | 345 | ○ | 264 | 11 | −25 |
| 14 | 437 | 630 | 69 | 219 | −135 | 380 | 324 | ○ | 230 | 11 | −40 |
| 15 | 450 | 641 | 70 | 217 | −135 | 380 | 327 | ○ | 243 | 26 | −35 |
| 16 | 499 | 712 | 70 | 277 | −125 | 380 | 339 | ○ | 302 | 25 | −30 |
| 17 | 221 | 365 | 61 | 125 | −180 | 320 | 290 | ○ | 102 | −23 | −35 |
| 18 | 566 | 631 | 90 | 210 | −20 | 220 | 209 | Δ | 248 | 38 | 30 |
| 19 | 275 | 385 | 71 | 123 | −165 | 330 | 281 | ○ | 100 | −23 | −30 |
| 20 | 551 | 662 | 83 | 225 | −50 | 260 | 249 | Δ | 348 | 123 | 45 |
| 21 | 522 | 653 | 80 | 218 | −60 | 260 | 256 | x | 320 | 102 | 20 |

** ○—good, Δ—fair, x—no good

What is claimed is:

1. A hot-rolled steel sheet having a low yield ratio, a high specific strength, and excellent toughness, comprising:

0.005 to less than 0.030 weight percent of carbon (C), 1.5 weight percent or less of silicon (Si), 1.5 weight percent or less of manganese (Mn), 0.020 weight percent or less of phosphorus (P), 0.015 weight percent or less of sulfur (S), 0.005 to 0.10 weight percent of aluminum (Al), 0.0100 weight percent or less of nitrogen (N), 0.0002 to 0.0100 weight percent of boron (B), at least one element selected from the group consisting of: 0.20 weight percent or less of titanium (Ti) and 0.25 weight percent or less of niobium (Nb) in an amount to satisfy $(Ti+Nb/2)/C \geqq 4$, and balance iron and incidental impurities;

wherein, the metal structure is selected from the group consisting of: ferrite and bainitic ferrite, and the carbon content dissolved in grains ranges from 1.0 to 4.0 ppm.

2. A hot-rolled steel sheet having a low yield ratio, a high specific strength, and excellent toughness according to claim 1, wherein the hot-rolled steel sheet further comprises at least one element selected from the group consisting of:

1.0 weight percent or less of molybdenum, 2.0 weight percent or less of copper, 1.5 weight percent or less of nickel, 1.0 weight percent or less of chromium, and

0.10weight percent or less of vanadium.

3. A hot-rolled steel sheet having a low yield ratio, a high specific strength, and excellent toughness, according to claim 1, wherein the hot-rolled steel sheet further comprises at least one element selected from the group consisting of:

0.0005 to 0.0050 weight percent of calcium, and 0.001 to 0.020 weight percent of a rare earth metal.

4. A method of producing a hot-rolled steel sheet having a low yield ratio, a high specific strength, and excellent toughness, comprising the steps of:

hot-rolling a steel slab containing:

0.005 to less than 0.030 weight percent of carbon (C), 1.5 weight percent or less of silicon (Si), 1.5 weight percent or less of manganese (Mn), 0.020 weight percent or less of phosphorus (P), 0.015 weight percent or less of sulfur (S), 0.005 to 0.10 weight percent of aluminum (Al), 0.0100 weight percent or less of nitrogen (N), 0.0002 to 0.0100 weight percent of boron (B), and at least one element selected from the group consisting of 0.20 weight percent or less of titanium (Ti) and 0.25 weight percent or less of niobium (Nb) in an amount to satisfy $(Ti+Nb/2)/C \geqq 4$;

cooling at a rate of between 5 and not more than 20° C./sec.; and then coiling at a temperature ranging from over 550° C. to 700° C.

* * * * *